US006588330B1

(12) United States Patent
Importico

(10) Patent No.: US 6,588,330 B1
(45) Date of Patent: Jul. 8, 2003

(54) TRASH COMPACTOR SYSTEM

(76) Inventor: Michael Importico, 3043 Ridge Ave., Egg Harbor Township, NJ (US) 08234

( * ) Notice: Subject to any disclaimer, the term of this patent is extended or adjusted under 35 U.S.C. 154(b) by 0 days.

(21) Appl. No.: 09/853,462

(22) Filed: May 11, 2001

Related U.S. Application Data

(60) Provisional application No. 60/205,374, filed on May 15, 2000.

(51) Int. Cl.[7] ..... B30B 9/00; B30B 7/00
(52) U.S. Cl. ..... 100/98 R; 100/233
(58) Field of Search ..... 100/98 R, 100, 100/233, 229 A

(56) References Cited

U.S. PATENT DOCUMENTS

| | | | | |
|---|---|---|---|---|
| 2,177,328 A | | 10/1939 | Pender | |
| 2,792,171 A | | 5/1957 | Rosset | |
| 3,065,586 A | * | 11/1962 | Ghiringhelli | 100/233 |
| 3,280,727 A | * | 10/1966 | Jonas | 100/233 |
| 3,713,581 A | | 1/1973 | Mullens | |
| 3,893,615 A | | 7/1975 | Johnson | |
| 4,114,776 A | | 9/1978 | Pluss | |
| 4,640,403 A | | 2/1987 | McDermott | |
| 4,727,804 A | | 3/1988 | Tondo et al. | |
| 4,987,988 A | | 1/1991 | Messina et al. | |
| 5,031,829 A | | 7/1991 | Shantzis | |
| 5,127,507 A | | 7/1992 | McDermott | |
| 5,155,976 A | | 10/1992 | Okabe et al. | |
| 5,190,165 A | | 3/1993 | Garfield, Jr. | |
| 5,228,577 A | | 7/1993 | Wilson | |
| 5,253,766 A | | 10/1993 | Sims | |
| 5,257,577 A | | 11/1993 | Clark | |
| 5,259,304 A | | 11/1993 | Roberts | |
| 5,271,507 A | | 12/1993 | Evans, Jr. | |
| 5,307,607 A | * | 5/1994 | Tondo | 100/233 |
| 5,316,152 A | | 5/1994 | Ross | |
| 5,366,097 A | | 11/1994 | Hazelwood | |
| 5,425,458 A | | 6/1995 | Gilcreest et al. | |
| 5,551,576 A | | 9/1996 | Importico | |
| 5,816,145 A | | 10/1998 | Lackner | |
| 5,960,710 A | * | 10/1999 | Holtom | 100/233 |

FOREIGN PATENT DOCUMENTS

DE 4215799 A1 11/1993

OTHER PUBLICATIONS

Kohlman Engineering Corp. Kompac—BV—Vertical Compactor, 11172/KOH/Buy Line 4547, pp. 3,4.
Kohlman Engineering Corp. Advanced Compactor and Chute Designs, 11172/KOH/Buy Line 4547, pp. 1–12.
Wastequip Accurate, Powerpak Compactors, ACCU–PAK 4—in—1 models D 600 D –800, 5/98 (2 pages).
Marathon Equipment Company, Verti–i–pack, Self–Contained Compactors/Containers, 6/89 (4 pages).
Tower Recycling Systems, Tower–Pak 2000.
Tower Recycling Systems, A Multi–Floor Recycling System, Model TRC—2—Model TRC—2s.
Tower Recycleing Systems, A Multi–Floor Recycling System, model TRS 60, Model TRL, Model TRC 60, Model TRS 60, 4 pages.
Kohlman Engineering Corp. Kompac—4 (1page).
Kohlman Engineering Corp., NRT 3000, High Rise Recycling 11172/KOH/Buy Line 454, Model NRT 3000/1—1Sort, Model NRT 3000/2–Sort2.

* cited by examiner

*Primary Examiner*—W. Donald Bray
(74) *Attorney, Agent, or Firm*—Caesar, Rivise, Bernstein, Cohen & Pokotilow, Ltd.

(57) ABSTRACT

A top loading trash compactor for compacting trash in a container is provided, including a packing head that is preferably generally pie-shaped in cross section, rotatably mounted to a frame about the apex of the pie-shape. A power unit is provided for providing power to rotate the packing head, via a driver, from a first position to a second position, the first position allowing trash to enter the container and the second position causing the trash to be compacted within the container. The frame holds the apex of the packing head above the container.

11 Claims, 7 Drawing Sheets

TRASH COMPACTOR SYSTEM

CROSS-REFERENCE TO RELATED APPLICATION

This utility application claims the benefit of U.S. Provisional Application Ser. No. 60/205,374, filed May 15, 2000.

BACKGROUND OF THE INVENTION

This invention relates generally to commercial trash compactors of the type usually found in apartment buildings. More particularly, this invention relates to trash compactors that allow a trash bin to be loaded and then uses a ram to compact the trash within the trash bin.

Collecting and transporting trash from urban areas has become a major industry throughout the civilized world. Because trash must be transported from urban areas to areas where it can be left in landfills or otherwise disposed of, an important function in transporting trash is to first compact it so as to reduce the volume required to transport a given weight of waste material. Trash compactors have been utilized in trash transfer stations where trash is brought by vehicles that collect it in urban areas and reprocessed and placed on larger vehicles for long haul transportation to remote landfills or other disposal locations. The trash compactor of the present invention contemplates an efficient compacting device in which trash is loaded into the top of the compactor and a pie-shaped ram is rotated around to compact the trash in a bin associated with the compactor.

OBJECTS OF THE INVENTION

Accordingly, it is a general object of the present invention to provide a top loading trash compactor which overcomes the disadvantages of the prior art.

It is a further object of the present invention to provide a top loading trash compactor for use in multistory apartment buildings.

It is yet another object of the present invention to provide a top loading trash compactor that compacts and stores trash with substantially no leakage.

It is still another object of the present invention to provide a top loading trash compactor that compacts and stores trash that can utilize a trash container or dumpster that has a plastic lid.

It is a further object of this invention to provide a top loading trash compactor that compacts and stores trash that may use a key start and/or an emergency stop button.

It is still a further object of the present invention to provide a top loading trash compactor that stores trash that has at least one indicator light that indicates when the trash container is, for example, eighty percent and one hundred percent full.

It is a further object of the present invention to provide a top loading trash compactor that stores trash that may utilize a variety of different trash storage containers or dumpsters.

It is a further object of the present invention to provide a top loading trash that is capable of accepting dumpsters designed for either front end loading trash trucks or rear end loading trash trucks.

It is yet another object of the present invention to provide a top loading trash compactor that stores trash, that may be operated manually by a switch or automatically operated upon trash being deposited or when the container is full to a certain volume, for example, using a photoelectric sensor.

It is another object of the present invention to provide a top loading trash compactor that stores trash that utilizes a minimum a floor space.

It is still another object of the present invention to provide a top loading trash compactor that requires a minimum number of compactions when filling the bin, thereby saving energy and wear and tear on the components of the trash compactor.

Finally, it is an object of the present invention to provide a top loading trash compactor that requires compacting only when the bin is substantially full and does not require compacting after only a small amount of trash, e.g., one or two bags, is placed in the bin.

SUMMARY OF THE INVENTION

These and other objects of this invention are achieved by providing a top loading trash compactor for compacting trash in a container. The trash compactor includes a packing head, rotatably mounted to a frame about an end of the packing head. A power unit is provided for providing power to rotate the packing head, via a driver, from a first position to a second position, the first position allowing trash to enter the container and the second position causing the trash to be compacted within the container. The frame holds the apex of the packing head above the container. Preferably, the packing head is pie shaped and rotates about the apex of the pie-shaped packing head.

The power unit is preferably mounted to the frame. The driver is preferably a hydraulic cylinder or a pneumatic cylinder or an electric motor. A shear blade adjacent to the packing head may be provided to shear off any trash entering the system from the packing head as the packing head is rotated. A wiper to assist in clearing trash off the packing head as it rotates may also be provided. Preferably, the packing head is a quarter cylinder and may move from the first position approximately ninety degrees to the second position.

DESCRIPTION OF THE DRAWINGS

Other objects and many attendant features of this invention will become readily appreciated as the same becomes better understood by reference to the following detailed description when considered in connection with the accompanying drawings, wherein.

DETAILED DESCRIPTION OF THE PREFERRED EMBODIMENT

Figure 1:
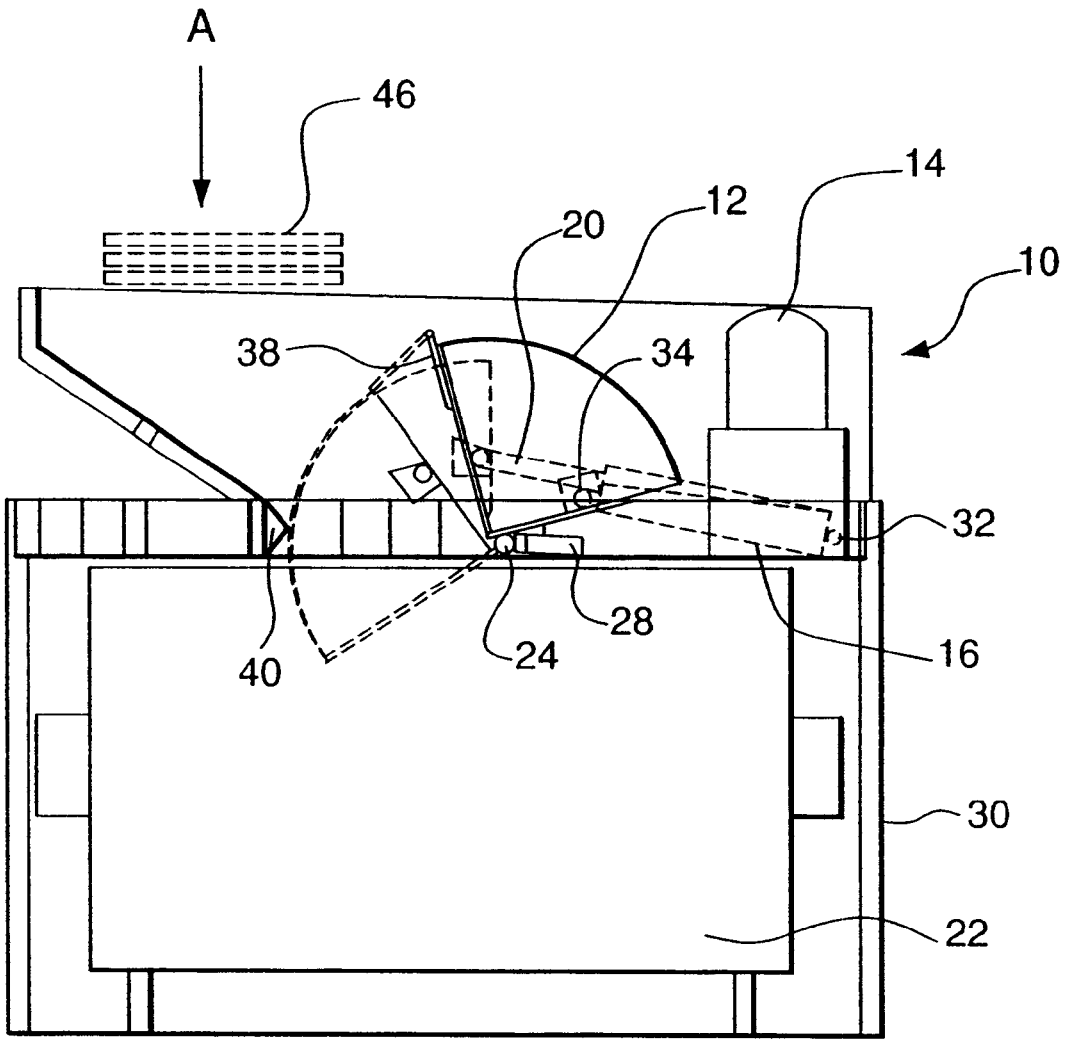
FIG. 1 is a cutaway, front elevation view of a trash compactor in accordance with one preferred embodiment of the present invention, with the packing head depicted in a first position to accept trash and with the packing head shown in a second position in broken lines in a fully rotated position to compact trash.
Figure 2:
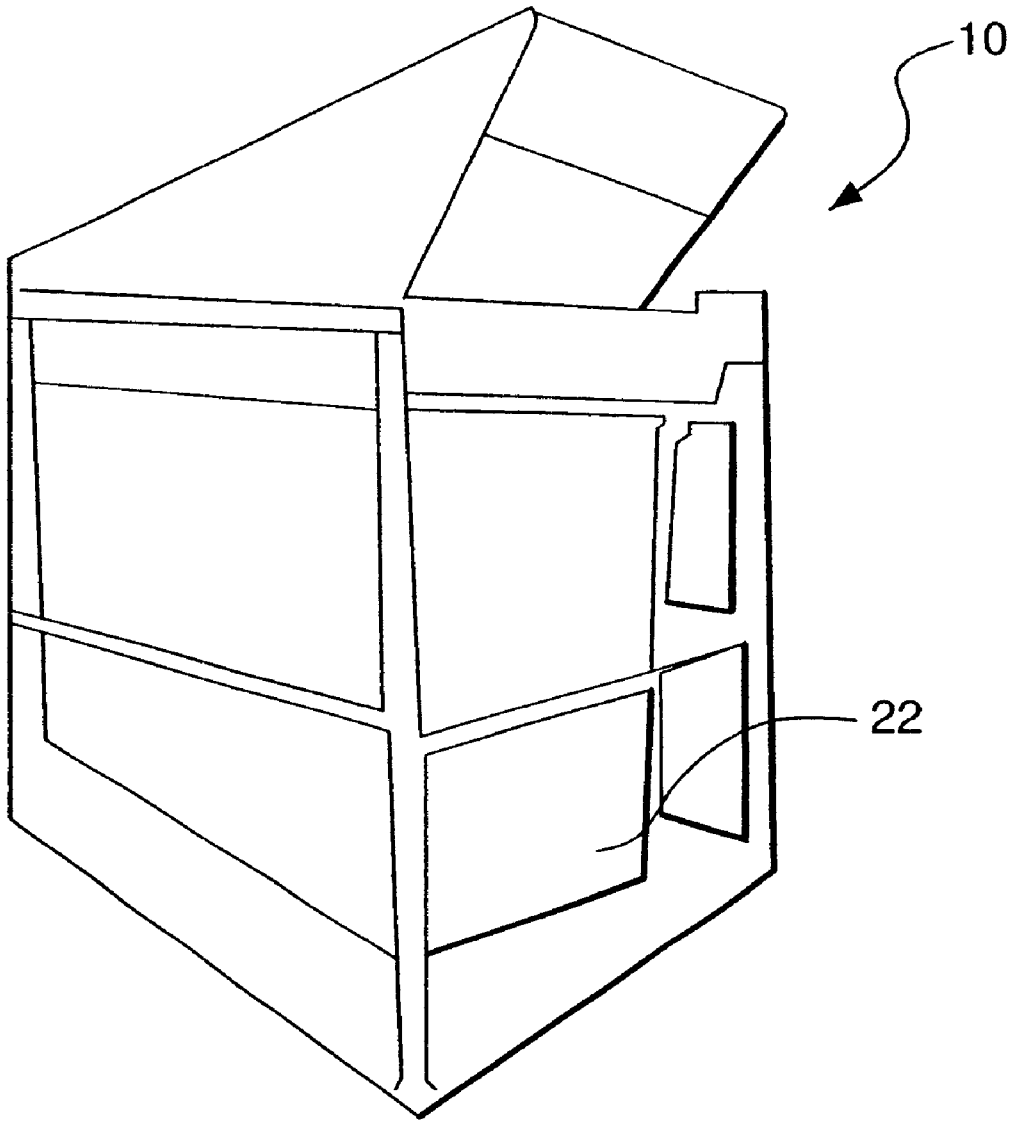
FIG. 2 is a simplified, isometric view of the trash compactor of FIG. 1.

Referring now to the various figures of the drawing where like reference numbers refer to like parts, there is shown in FIGS. 1 through 6 a top loading trash compactor 10 in accordance with one preferred embodiment of the present invention. The trash compactor 10 utilizes a packing head 12, operated by a power unit 14, for example, a five horsepower electric motor. The power unit 14 is preferably connected to the compacting head by a driver such as hydraulic cylinder 16. For example, a hydraulic cylinder having a four inch diameter cylinder 16 with a two inch diameter shaft 20 may be used. However, any suitable mechanical, pneumatic, or other linkage may also be utilized.

Figure 4:
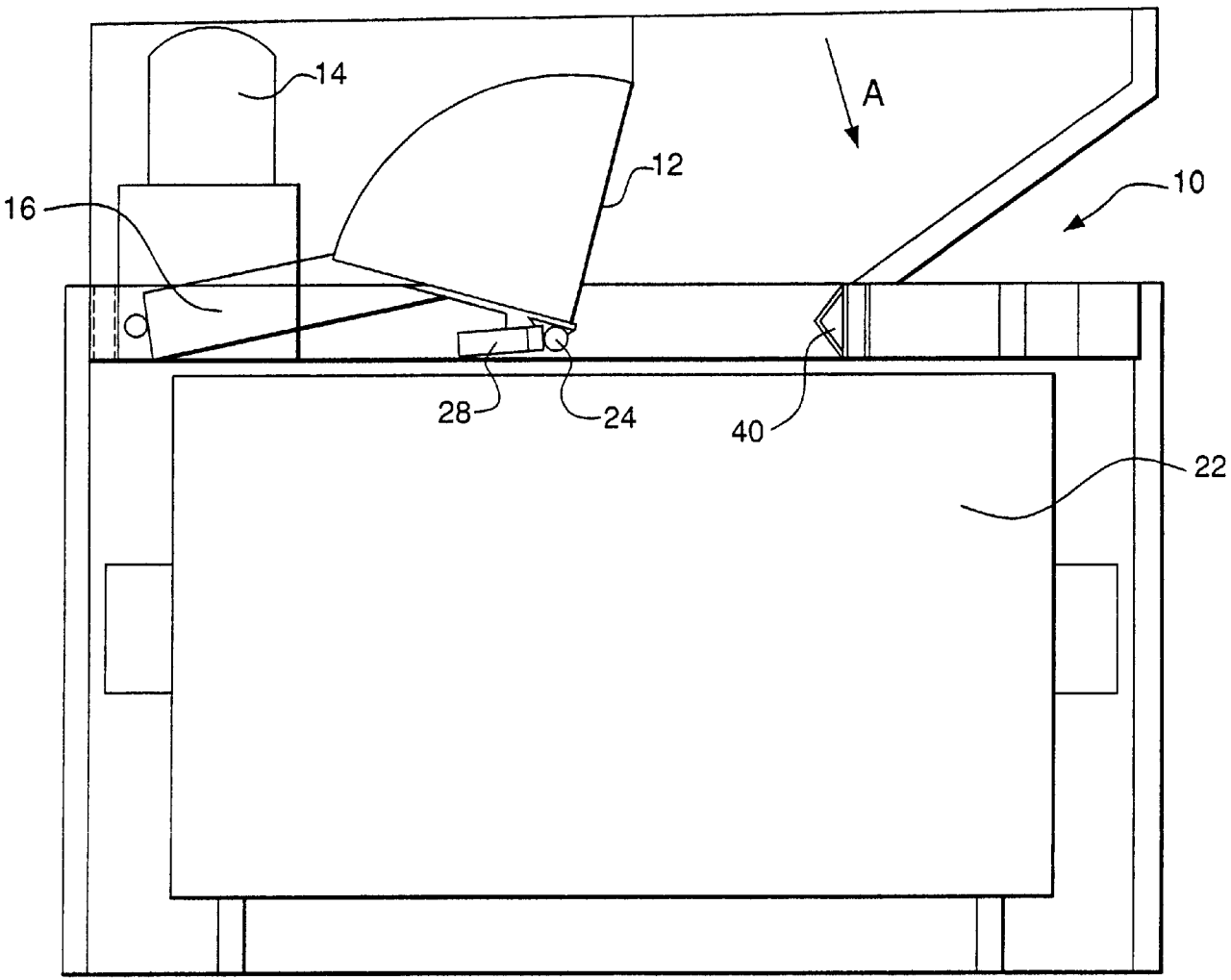
FIG. 4 is a simplified, cutaway, rear elevation view of the trash compactor of FIG. 1 with the packing head depicted in the first position.
Figure 5:
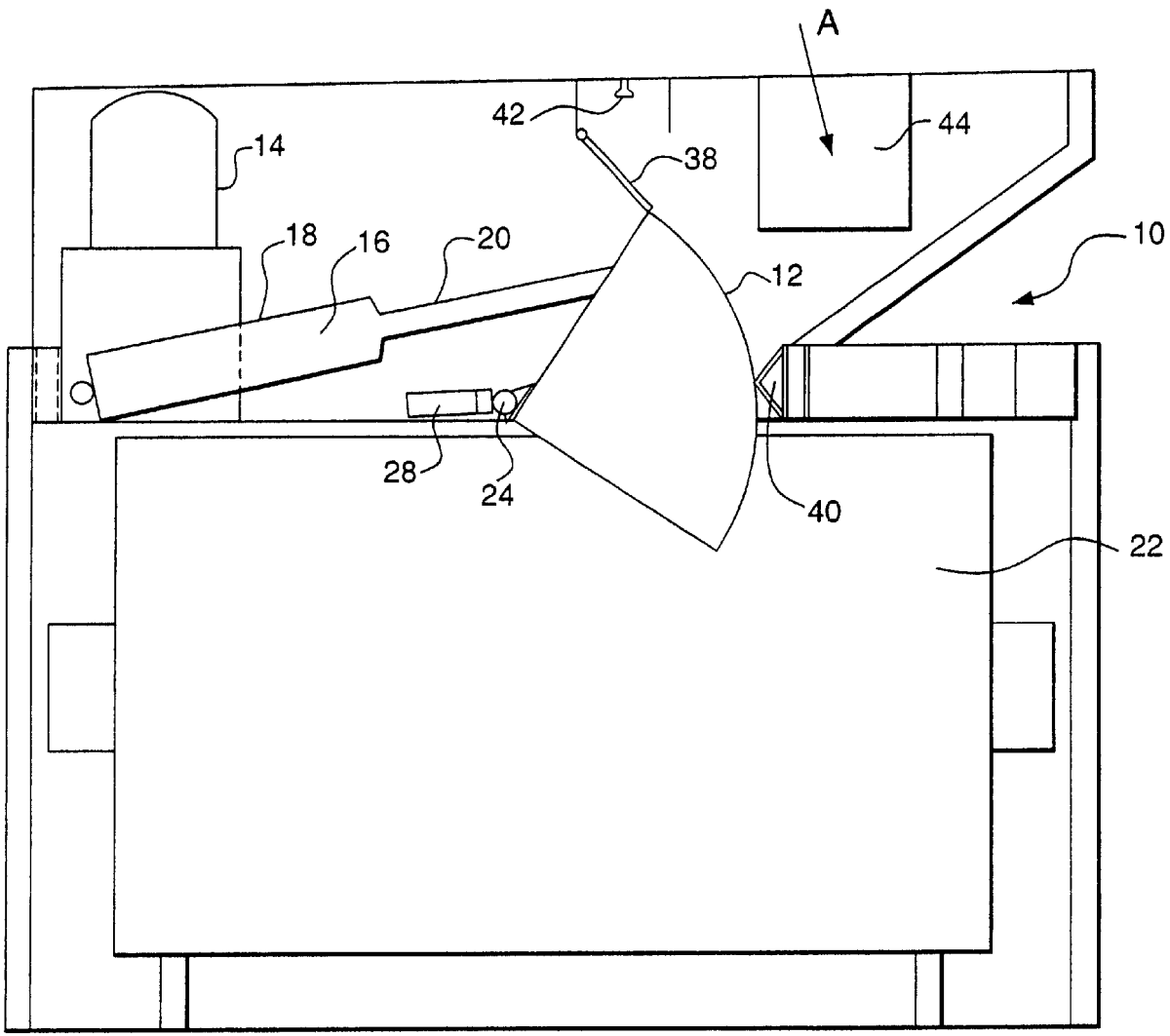
FIG. 5 is a simplified, cutaway, rear elevation view of the trash compactor of FIG. 1 with the packing head in the second position.
Figure 6:
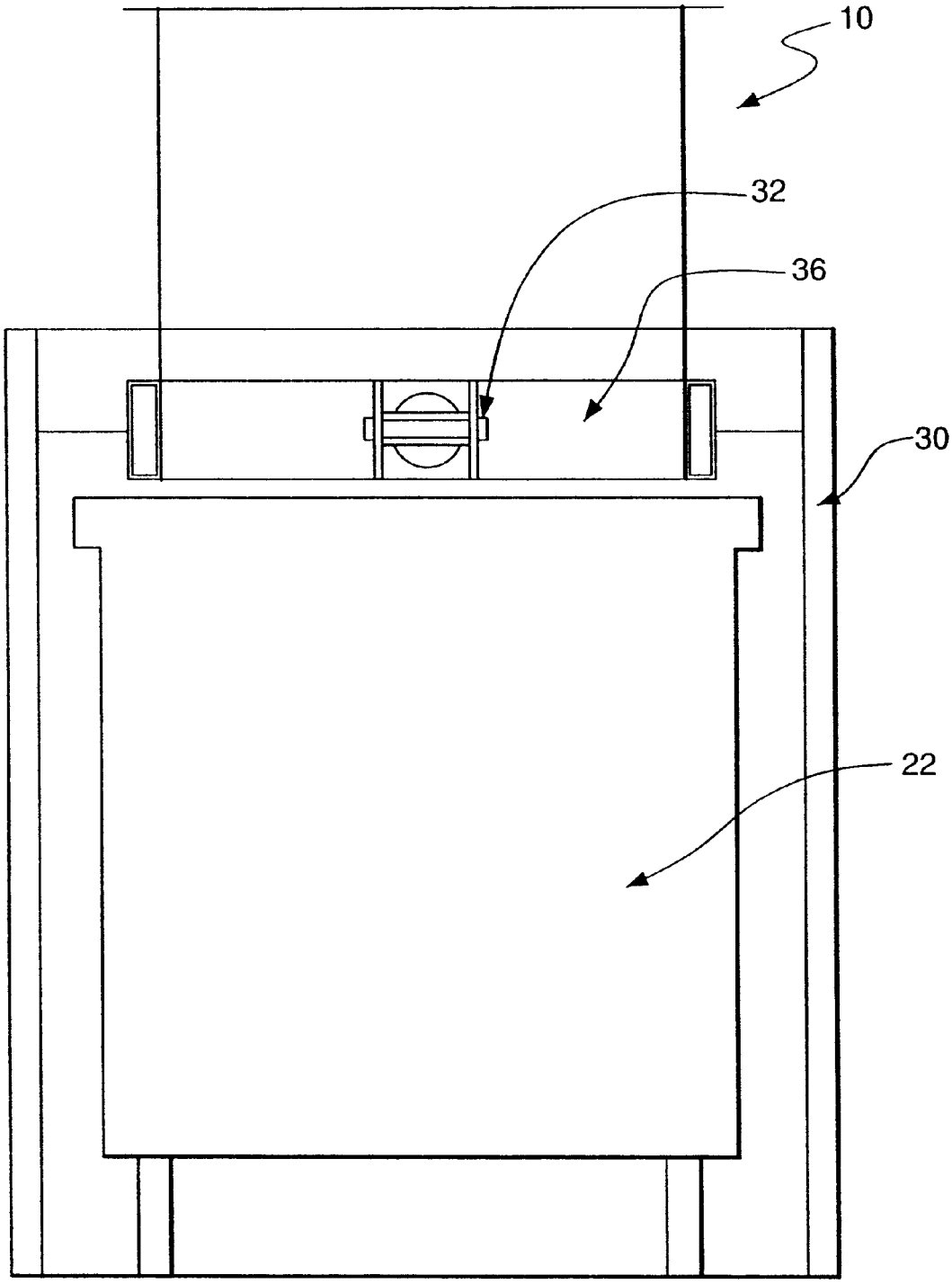
FIG. 6 is a right side elevation view of the trash compactor of FIG. 1.
Figure 7:
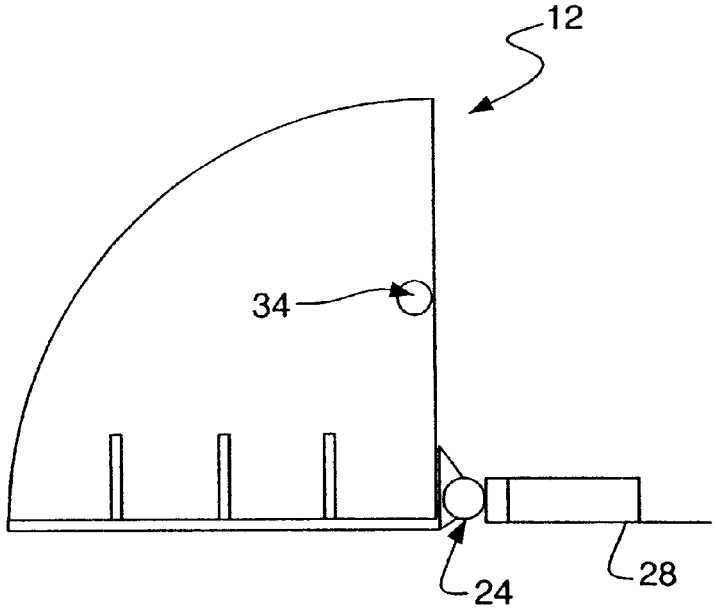
FIG. 7 is a front elevation view of packing head for use with the trash compactor of FIG. 1.
Figure 8:
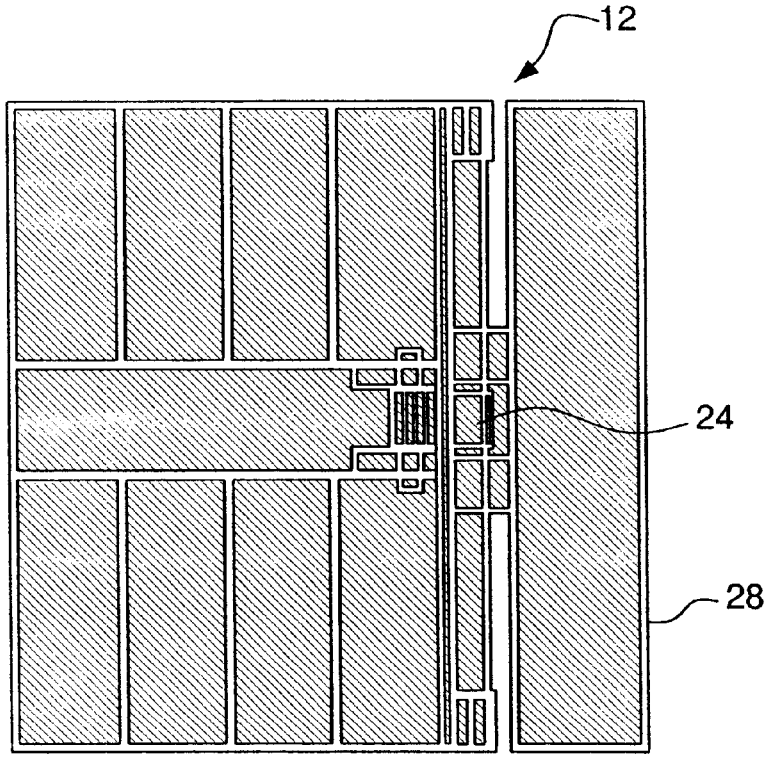
FIG. 8 is a bottom view of the packing head of FIG. 7.

The packing head 12 is preferably pie-shaped in cross section, as clearly can be seen in FIGS. 4 and 5 and runs substantially the entire width of the unit such that the compacting head compresses trash for the entire width of the trash container or dumpster 22. FIG. 8 depicts a bottom view of the packing head 12. The packing head 12 in the present embodiment is therefore a quarter of a cylinder in shape.

FIG. 1 depicts the top loading trash compactor 10 of the present invention with the packing head 12 depicted in a first position to accept trash. FIG. 1 also depicts the packing head 12 fully rotated to a second position with the packing head 12 shown in broken lines in a position to compact trash. The power means 14 here includes a pump to pump hydraulic fluid into a driver such as cylinder 16 to cause cylinder 16 to extend, thereby causing packing head 12 to rotate around packing head pivot point or hinge 24. Pivot point 24 is mounted to support 28 (see FIG. 8) which is integrally attached to the frame 30 of the trash compactor 10. One end of the cylinder 16 is pivotally mounted to the frame 30 on back support 36 at cylinder pivot point 32. The other end of the cylinder 16 is pivotally mounted to the packing head 12 at pivot point 34.

Figure 3:
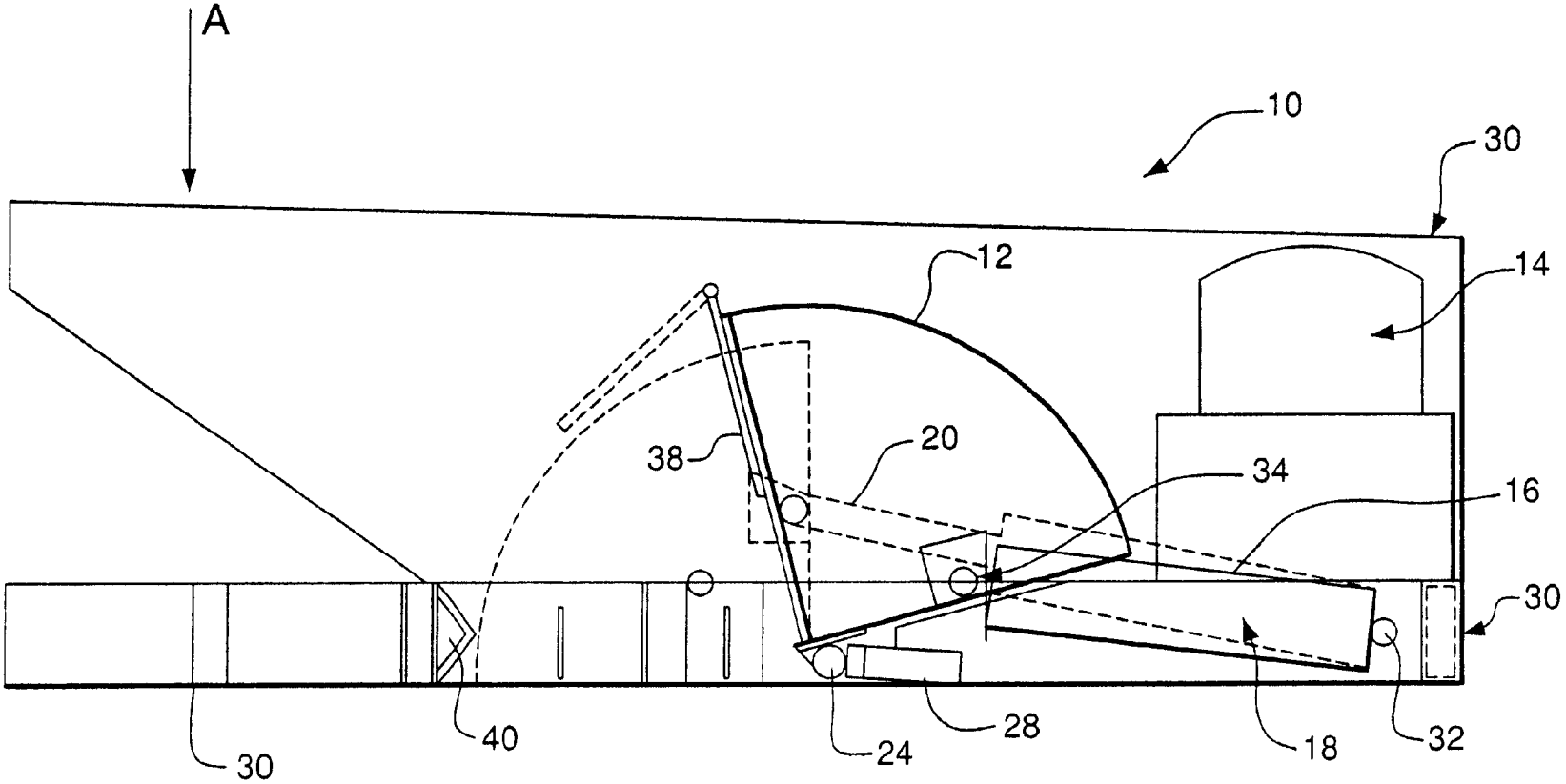
FIG. 3 is a simplified, cutaway, front elevation view of a compactor portion of the trash compactor of FIG. 1 with the packing head depicted in the first position and the packing head depicted in a third, mid point position in broken lines.

In the present embodiment, the packing head is preferably pie-shaped in cross-section, as described above, with the pie-shape being approximately a ninety degree slice of pie. The packing head preferably rotates slightly less than ninety degrees from the first position as depicted in FIGS. 1, 3 and 4 to the second, fully rotated position as depicted in FIG. 1 in broken lines and in FIG. 5. This yields a ram penetration into the container 22 of approximately 12 inches.

Trash enters the trash compactor 10 in the open position. Either manually by operating a switch, or automatically at certain timed intervals or when the trash in the compactor 10 reaches a certain level, the power unit 14 is energized which causes hydraulic fluid to flow into hydraulic cylinder 16 which causes the packing head 12 to rotate about pivot point 24, thereby compacting any trash in trash container 22.

In operation, trash enters the trash compactor 10 in direction A through, for example, a 24 inch chute 46 from above while the packing head is in the first position. Upon an electrical signal issued by either a manual switch, a timer, or a trash height sensor within the container 22, the power unit is energized which causes the packing head to rotate and pack trash within the container 22.

Optionally, as shown in FIGS. 1, 3 and 5, a wiper 38 may be included which aids in providing an appropriate path for trash entering the system and also rotates to wipe the packing head 12 as it rotates from the first position to the second position. Additionally, there is shown in FIGS. 1, 3, 4, and 5 an optional shear blade 40 which serves to cut like a scissor such that no trash sticks down into the trash container from above as the packing head 12 rotates to the second position. Finally, there is shown in FIG. 5 an optional fire sprinkler 42 as may be required by law and access door 44 to gain entry for servicing and unjamming of trash.

The present system, being a top loading system, is preferably for use in multi-story apartment buildings. In the past, trash systems for apartment buildings required marrying a specific trash container with a machine. Here, since the trash containers are located underneath the compactor, significantly more flexibility as to choice of container is available.

The present design allows for elimination of all openings in the side of the container from which waste material can leak or spill in the trash room or while truck is dumping. The packing head sits above the dumpster eliminating heavy metal lids and ratchets. The present design also saves space for chute feed apartment buildings.

Without further elaboration, the foregoing will so fully illustrate our invention that others may, by applying current or future knowledge, readily adopt the same for use under various conditions of service.

I claim:

1. A top loading trash compactor for compacting trash in a container, comprising:

(a) a packing head, rotatably mounted to a frame about an end of said packing head;

(b) a power unit for providing power to rotate said packing head, via a driver, from a first position to a second position, said first position adapted to allow trash to enter said container only from a direction above the packing head, said second position causing the trash to be compacted within said container; and (c) said frame adapted to hold said end of said packing head above said container.

2. The top loading trash compactor of claim 1, wherein said packing head is generally pie-shaped in cross-section and said packing head rotates about an apex of said pie-shaped packing head.

3. The top loading trash compactor of claim 1, wherein said power unit is mounted to said frame.

4. The top loading trash compactor of claim 1, wherein said driver is a hydraulic cylinder.

5. The top loading trash compactor of claim 1, wherein said driver is a pneumatic cylinder.

6. The top loading trash compactor of claim 1, wherein said driver is an electric motor.

7. The top loading trash compactor of claim 1, including a shear blade having a single blade abutting said packing head to shear off any trash entering said system from said packing head when said packing head is rotated.

8. The top loading trash compactor of claim 1, including a wiper to assist in clearing off said packing head of trash as it rotates.

9. The top loading trash compactor of claim 1, wherein said packing head is a quarter cylinder.

10. The top loading trash compactor of claim 1, wherein said packing head moves from said first position approximately ninety degrees to said second position.

11. A top loading trash compactor for compacting trash in a container, comprising:

(a) a packing head that is generally pie-shaped in cross section, rotatably mounted to a frame about an apex of said pie-shaped packing head;

(b) a power unit for providing power to rotate said packing head, via a driver, from a first position to a second position, said first position adapted to allow trash to enter said container only from a direction above the packing head, said second position causing the trash to be compacted within said container; and (c) said frame adapted to hold said apex of said packing head above said container.

* * * * *